US005684717A

United States Patent [19]

Beilfuss et al.

[11] Patent Number: 5,684,717

[45] Date of Patent: Nov. 4, 1997

[54] APPARATUS FOR MONITORING OPERATION OF HEATING AND COOLING SYSTEMS

[75] Inventors: Robert C. Beilfuss, Smyrna; Son V. Tran, Murfreesboro, both of Tenn.

[73] Assignee: Heatcraft Inc., Grenada, Miss.

[21] Appl. No.: 615,098

[22] Filed: Mar. 14, 1996

[51] Int. Cl.[6] ..... F27D 21/00

[52] U.S. Cl. ..... 364/550; 340/825.16

[58] Field of Search ..... 364/550, 481, 364/424.03; 340/825.16, 825.17, 825.36, 825.37; 324/512, 555; 395/905, 911, 916; 62/125, 127

[56] References Cited

U.S. PATENT DOCUMENTS

| | | | |
|---|---|---|---|
| 4,703,325 | 10/1987 | Chamberlin et al. . | |
| 4,823,280 | 4/1989 | Mailandt et al. . | |
| 4,831,560 | 5/1989 | Zaleski | 364/551.01 |
| 4,845,486 | 7/1989 | Knight et al. . | |
| 4,996,703 | 2/1991 | Gray . | |
| 5,119,412 | 6/1992 | Attallah . | |
| 5,400,018 | 3/1995 | Scholl et al. | 340/825.54 |
| 5,408,412 | 4/1995 | Hogg et al. | 364/424.03 |
| 5,495,722 | 3/1996 | Manson et al. . | |

*Primary Examiner*—Emanuel T. Voeltz
*Assistant Examiner*—Thomas Peeso
*Attorney, Agent, or Firm*—W. Kirk McCord

[57] ABSTRACT

Apparatus is provided for monitoring operation of a heating and/or cooling system. The apparatus includes a programmed first processor for processing data relating to selected system operating conditions and for transmitting coded data signals indicative thereof, and a portable display module having an electrical conduit for electrically connecting the module to the first processor to provide one-way electrical communication therebetween. The module further includes a programmed second processor for processing the data signals transmitted by the first processor and a display device which is controlled by the second processor to provide a human readable indication of selected system operating conditions, including the current mode of operation of the system and any detected failure conditions. The first processor includes a memory for storing past system failure conditions. The apparatus includes a memory operable switch for inputting a signal to the first processor. In response to the input signal, the first processor transmits a coded data signal indicative of the last known system failure condition, even if such failure con&ion is no longer present.

20 Claims, 8 Drawing Sheets

APPARATUS FOR MONITORING OPERATION OF HEATING AND COOLING SYSTEMS

FIELD OF INVENTION

This invention relates generally to monitoring apparatus and in particular to improved apparatus for monitoring operation of heating and cooling systems.

BACKGROUND ART

Monitoring heating and cooling systems for potential and/or actual malfunctions is a significant aspect of maintenance and repair of such systems. Undesirable consequences may result if such malfunctions or potential malfunctions remain undetected and unrepaired.

According to prior practice, various types of malfunction indicators have been used, including alarms, buzzers, flashing and/or static lights, etc. However, such malfunction indicators typically do not indicate a specific malfunction or problem. It is also known in the art to provide continuous monitoring of heating and cooling systems and to send a signal indicative of system malfunction via telephone modem or the like. Such continuous monitoring apparatus, while having the advantage of identifying specific malfunctions, usually require dedicated telephone lines and expensive monitoring equipment.

There is therefore a need for improved apparatus for monitoring operation of heating and cooling systems, which is relatively inexpensive and yet which identifies specific system operating conditions and malfunctions.

SUMMARY OF INVENTION

In accordance with the present invention, apparatus is provided for monitoring operation of a heating and/or cooling system. The apparatus includes first processing means for processing data relating to operation of the system in accordance with a first set of program instructions and for transmitting coded data signals indicative of selected system operating conditions, and a portable display module having connecting means for electrically connecting the module to the system, whereby the data signals are transmitted to the display module. The display module further includes second processing means for processing the data signals in accordance with a second set of program instructions and for providing a human detectable output indicating selected system operating conditions.

In accordance with one feature of the invention, the apparatus is a passive monitoring apparatus, which waits for the heating and/or cooling system being monitored to transmit the data signals. As such, the operation of the heating and/or cooling system is not interrupted.

In accordance with another feature of the invention, the apparatus includes display means which is controlled by the second processing means to provide a human readable indication of selected system operating conditions.

In accordance with still another feature of the invention, the apparatus includes user controllable input means for inputting a control signal to the first processing means. The first processing means is operative to transmit a data signal to the second processing means indicative of a last known system failure condition in response to the control signal. The second processing means in turn controls the display means to provide a human readable indication of the last known system failure condition.

In the preferred embodiment, the apparatus is used to monitor operation of a heating system having automatic ignition control. The apparatus is connectible to the ignition control by means of an electrical conduit for receiving data signals transmitted by the first processing means, which is also programmed to effect automatic ignition control and is preferably resident on an ignition control printed circuit board in the heating system.

The monitoring apparatus according to the present invention may be programmed to monitor operation of various types of heating systems, such as gas-fueled furnaces, gas-fired water heaters and combination water heating/space heating systems.

BEST MODE FOR CARRYING OUT THE INVENTION

In the description which follows, like parts are marked throughout the specification and drawings with the same respective reference numbers. The drawings are not necessarily to scale and in some instances proportions may have been exaggerated in order to more dearly depict certain features of the invention.

Figure 1:
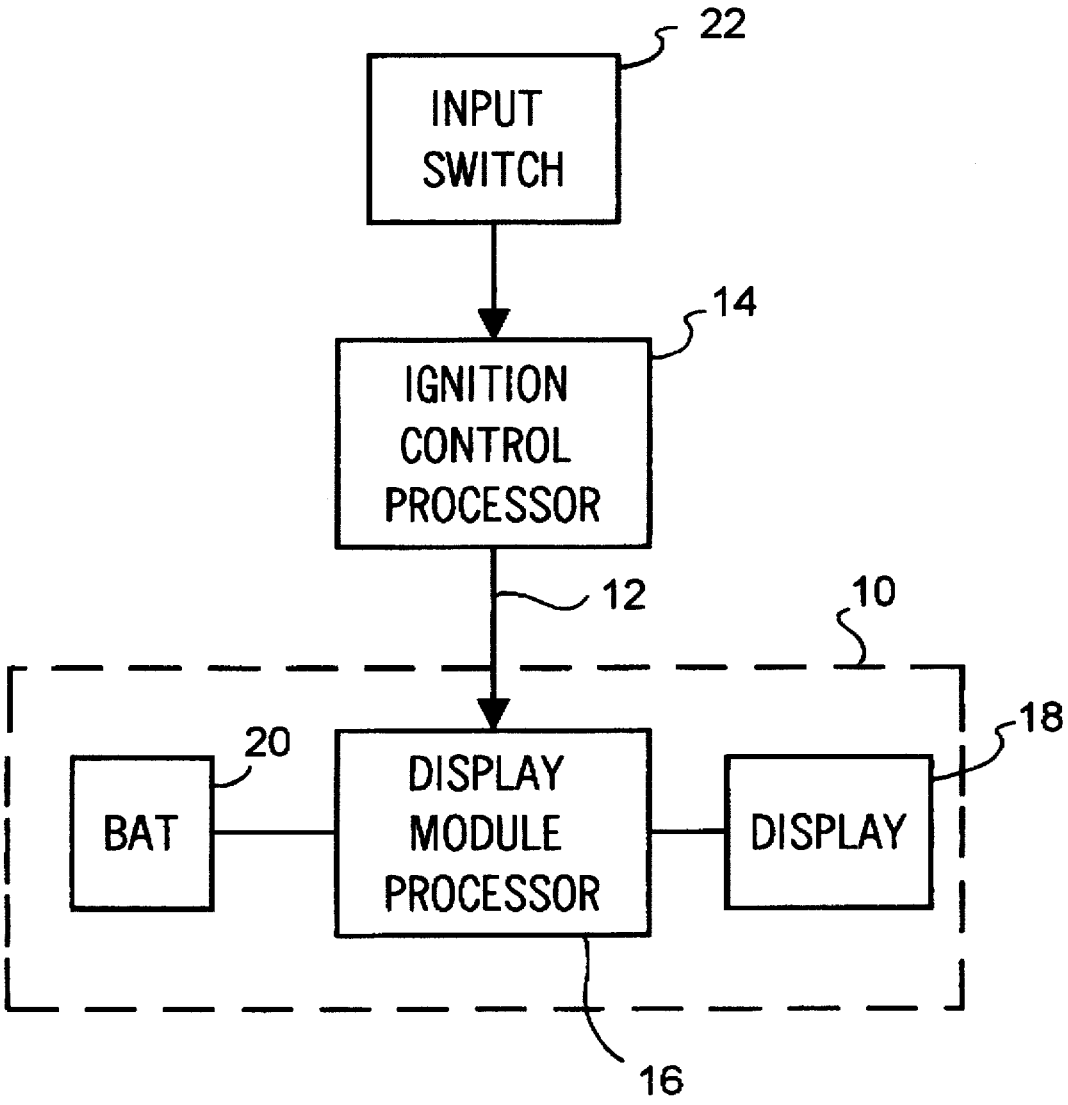
FIG. 1 is a simplified block diagram of apparatus for monitoring operation of a heating system, according to the present invention.

Referring to FIG. 1, apparatus for monitoring operation of a heating system (not shown) is depicted. The monitoring apparatus includes a portable display module 10 having an electrical conduit 12 for connecting module 10 to an ignition control printed circuit board (not shown) of the heating system, and an ignition control processor 14, which is resident on the ignition control printed circuit board of the heating system. Processor 14 is programmed to transmit coded data signals indicative of selected operating modes of the heating system, which will be described in greater detail hereinafter. For example purposes only, the operation of the monitoring apparatus will be described hereinbelow with reference to a combination space heating/water heating system. However, the monitoring apparatus of the present invention is not limited to monitoring operation of a combination space heating/water heating system, but may also be used to monitor operation of other types of heating and/or cooling systems, such as gas-fueled furnaces, stand-alone water heaters, air conditioning systems and combination heating/cooling systems, such as heat pumps and packaged heating/cooling units.

Display module 10 includes a processor 16, a display device 18, which is preferably a liquid crystal display, and a battery power supply 20. When display module 10 is connected by means of conduit 12 to the heating system's ignition control printed circuit board, processor 16 is operative to process the data signals received from processor 14 in accordance with a predetermined set of program instructions and to control display device 18 to display selected operating modes of the heating system in human-readable form, as will be described in greater detail hereinafter. Processor 14 and processor 16 are each preferably microcomputers of the ST62T25B6 type, manufactured and sold by SGS-Thomson Microelectronics.

In accordance with one aspect of the invention, the communication protocol between processor 14 and processor 16 is one-way only, that is, data signals are transmitted from processor 14 to processor 16. Of course, the main function of processor 14 is to control the ignition sequence in the heating system. Since processor 16 is passive, it waits to receive data signals from processor 14. Accordingly, the ignition control operation of processor 14 is not in any way interrupted by processor 16.

In accordance with another aspect of the invention, the monitoring apparatus includes a user-controllable input switch 22. In response to activation of switch 22, processor 14 transmits a data signal indicative of the most recently detected failure condition (i.e., the last failure state) of the system, even if the last failure state is no longer present. Processor 16 is programmed to decode the data signals transmitted by processor 14 and includes a memory for storing the decoded data.

Figure 2A:
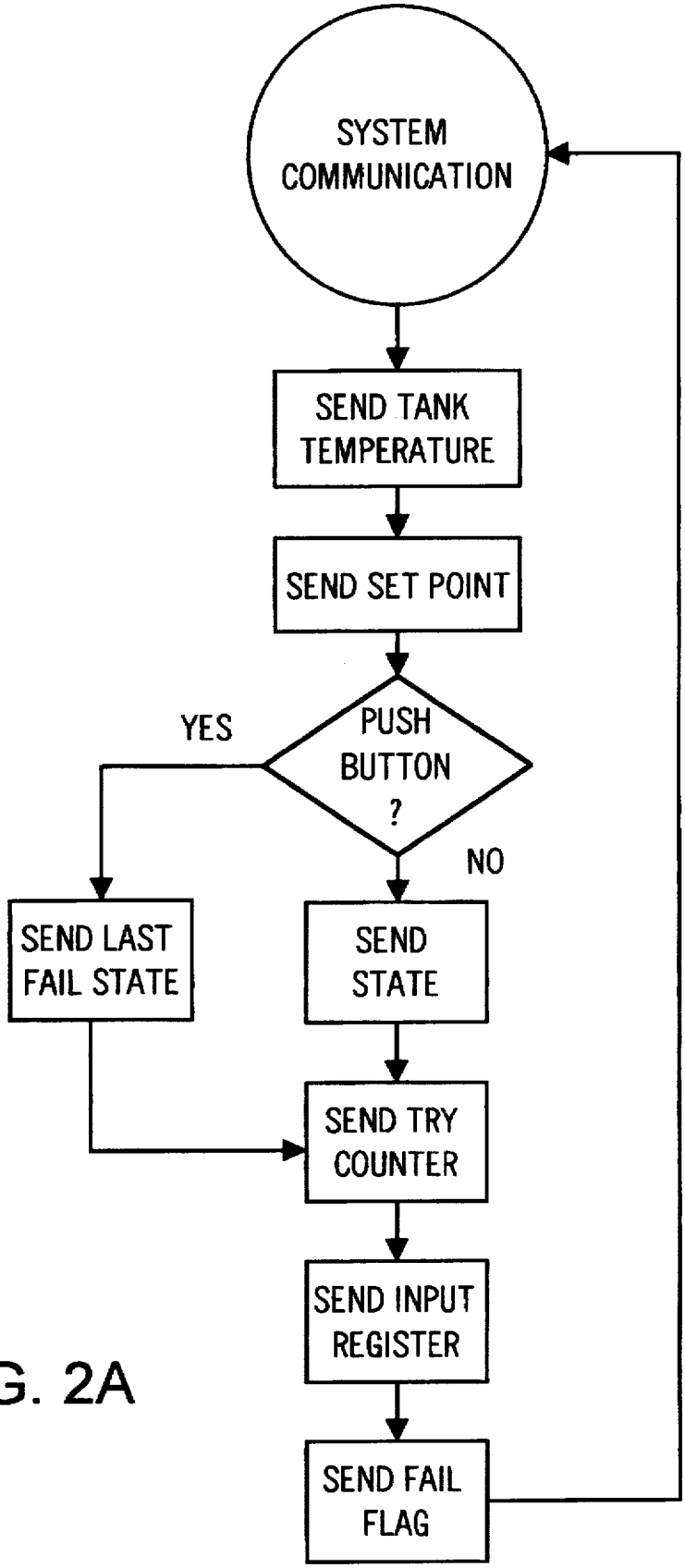
FIGS. 2A–2G are flow diagrams illustrating operation of the apparatus of FIG. 1.
Figure 2B:
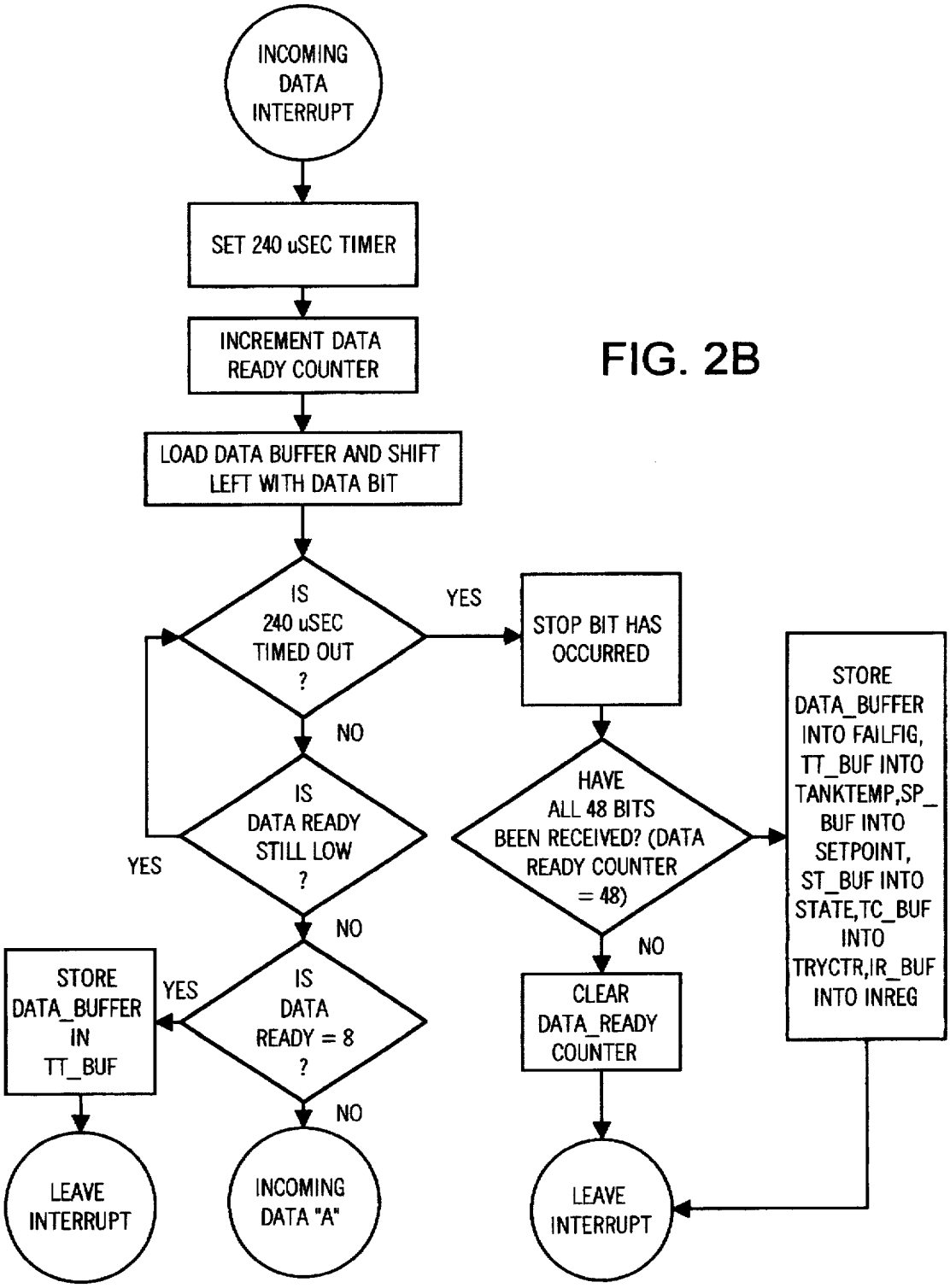
Figure 2C:
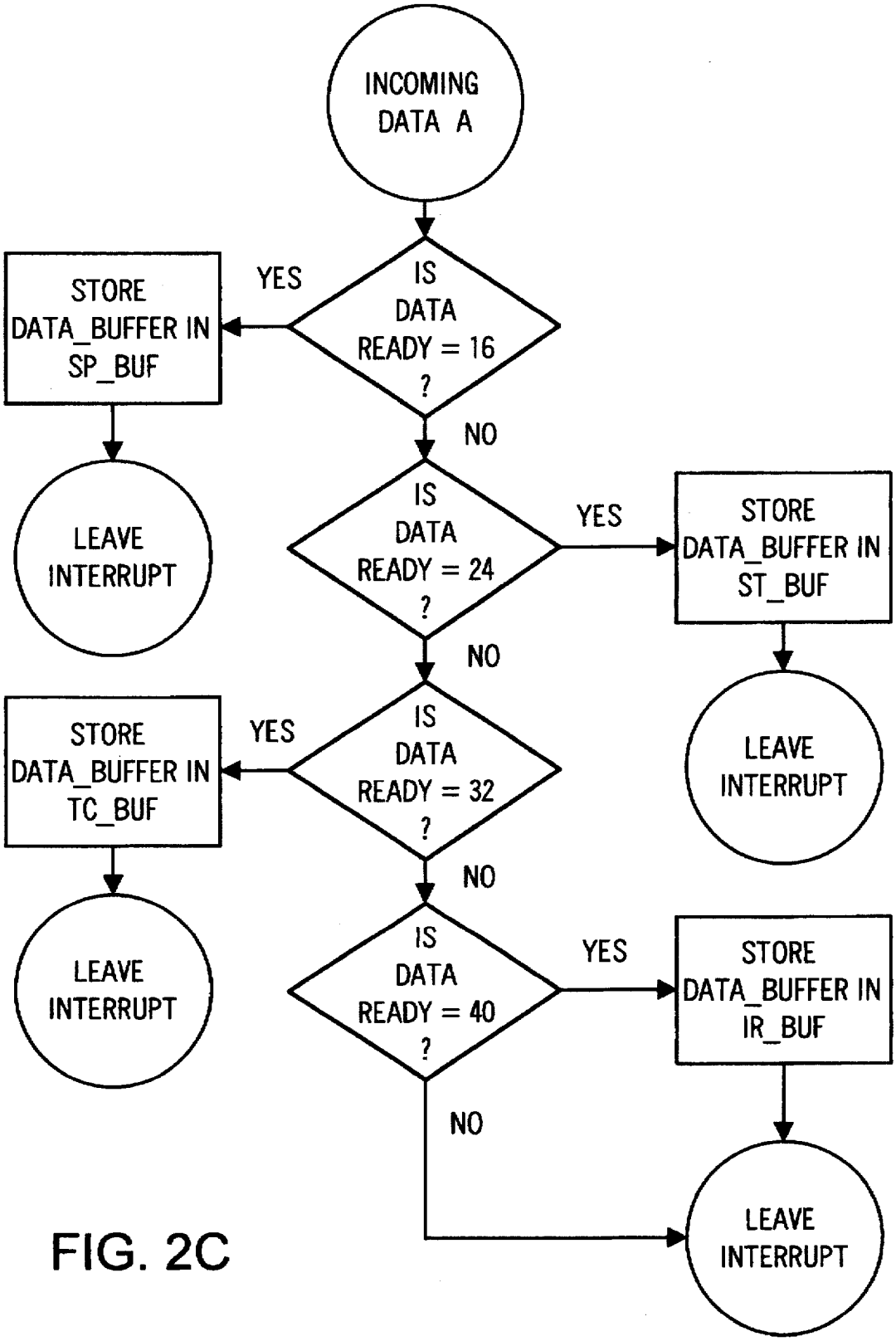

Referring also to FIGS. 2A–2G, operation of the monitoring apparatus according to the present invention will now be described in detail. FIG. 2A depicts the Data Transmission Routine of processor 14. FIGS. 2B and 2C depict the Incoming Data Interrupt Routine of processor 16. Processor 16 continually refreshes display device 18, while it waits for data signals from processor 14.

When processor 14 is not transmitting data, it generates a binary coded "high" Data Ready signal. When the Data Ready signal goes "low", it indicates that processor 14 is ready to transmit data. Data is transmitted one bit at a time as a series of relatively short (e.g., 10 microseconds) pulses, with a longer interval (e.g., approximately 1 millisecond) between successive data pulses. The data is transmitted on a different transmission line from the Data Ready signal. The Data Ready signal is normally "high". Each time the Data Ready signal goes "low" it is an indication that a data bit is being transmitted. Processor 16 refreshes display device 18 between successive data pulses.

As indicated in FIG. 2B, when the Data Ready signal goes "low", processor 16 sets a 240 microsecond timer and increments a Data Ready Counter to begin counting the data bits. An eight-bit Data Buffer is loaded with the incoming data and as each data bit is transmitted by processor 14, the data already stored in the Data Buffer is left-shifted.

As shown in FIG. 2A, data is transmitted by processor 14 in the following sequence: Tank Temperature, Temperature Setpoint, Operating State, Ignition Try Counter, Input Register Data and Failure Condition Data. When the Data Ready Counter indicates a first eight-bit count (Data Ready=8), the eight bits of data in the Data Buffer are stored in the Tank Temperature Buffer (TT_Buf). The first eight bits of data indicate the temperature of the water stored in the tank of the combination water heating/space heating system.

As indicated in FIG. 2C, when the Data Ready Counter indicates a second eight-bit count (Data Ready=16), the eight bits of data in the Data Buffer are stored in the Setpoint Buffer (SP_Buf). The second eight bits of data indicate the desired temperature of the water stored in the tank. When the Data Ready Counter indicates a third eight-bit count (Data Ready=24), the eight bits of data in the Data Buffer are stored in the State Buffer (ST_Buf). The third eight bits of data indicate the current operating mode or state of the system. When the Data Ready Counter indicates a fourth eight-bit count (Data Ready=32), the eight bits of data in the Data Buffer are stored in the Try Counter Buffer (TC_Buf). The fourth eight bits of data indicate the number of tries or attempts to ignite a gas-air fuel mixture to heat the water stored in the tank. When the Data Ready Counter indicates a fifth eight-bit count (Data Ready=40), the eight bits of data in the Data Buffer are stored in the In Register Buffer (iR_Buf). The fifth eight bits of data indicate selected system inputs to processor 14, such as, for example, a demand for space heating signal from a room thermostat. The sixth and last eight bits of data indicate any failure condition or other malfunction in the system so that the entire data stream consists of forty-eight bits (six bytes of eight bits each). After all forty-eight bits have been transmitted, the Data Ready signal will remain low for 240 microseconds or more.

As indicated in FIG. 2B, when processor 16 detects that the Data Ready signal has remained low for 240 microseconds or more, it knows that a "Stop" bit has occurred, which means that the data transmission has ceased. If all forty-eight bits have been received, then the data is deemed to be valid and the data is transferred from the temporary storage buffers into permanent memory storage locations for access by processor 16. As indicated in FIG. 2B, the last eight bits of data in the Data Buffer is stored in the Failure Flag (Failfig.) memory location. The Tank Temperature Buffer is stored in the Tank Temperature flank (Tank Temp.) memory location, the Setpoint Buffer is stored in the Setpoint memory location, the State Buffer is stored in the State memory location, the Try Counter Buffer is stored in the Try Counter (Tryctr) memory location, and the In Register Buffer is stored in the In Register (InReg.) memory location. If the data stream consists of less than forty-eight bits, the data is discarded and the Data Ready Counter is cleared.

Figure 2D:
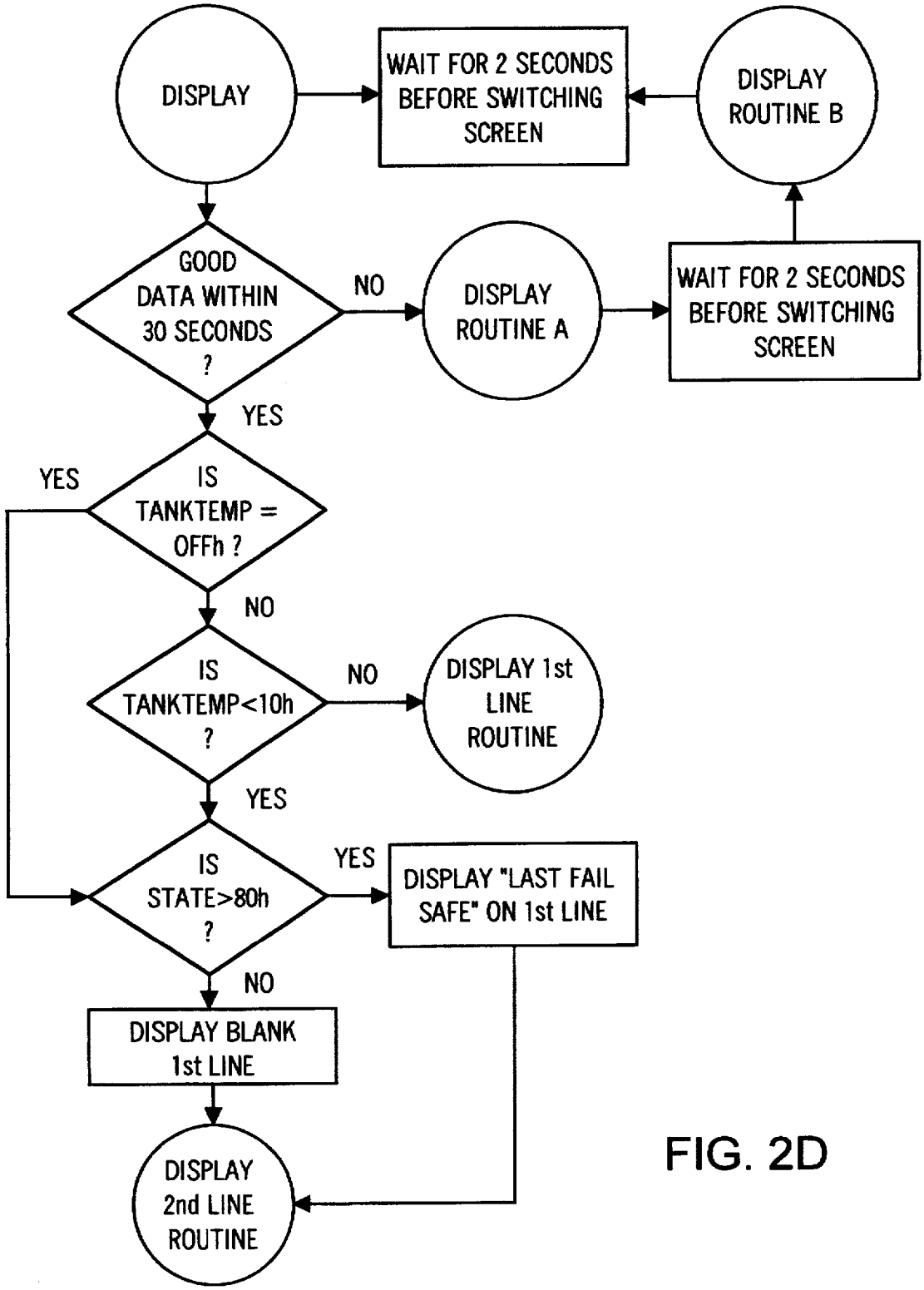

The Display Routine is depicted in FIG. 2D. If processor 16 does not receive valid data within thirty seconds it will execute Display Routine A for two seconds and then execute Display Routine B for two seconds. Until valid data is received, processor 16 will continue to alternately execute Display Routine A and Display Routine B. Display device 18 has the capability to display two lines of sixteen characters.

Figure 2E:
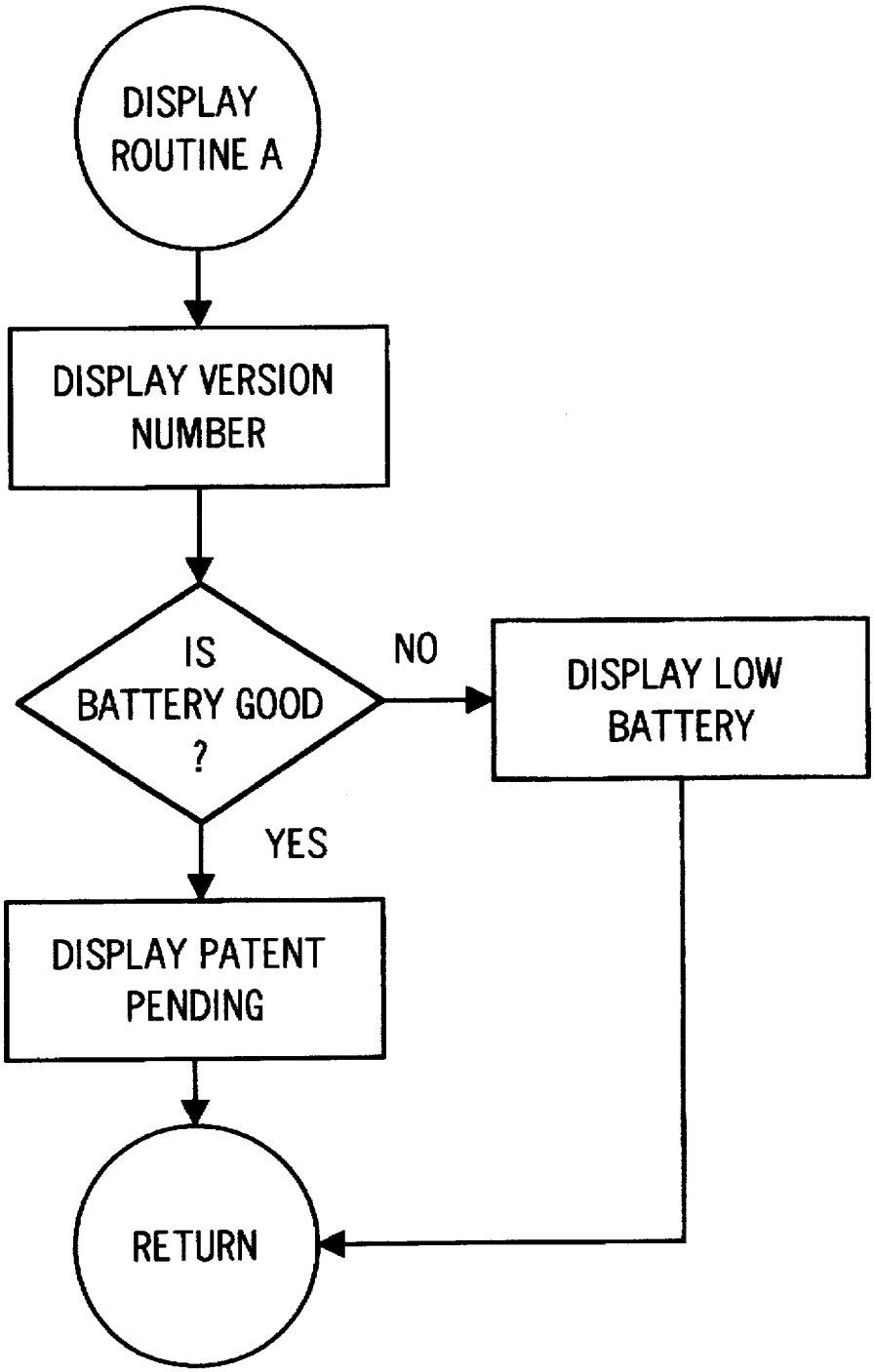

Display Routine A is depicted in FIG. 2E. Processor 16 controls display device 18 to display the version of the software instructions for which processor 16 is programmed (Display Version Number) on the first line of display device 18 and the words "Patent Pending" (Display Patent Pending) on the second line of display device 18. Further, processor 16 will control display device 18 to indicate a low battery condition (Display Low Battery), if applicable.

Figure 2F:
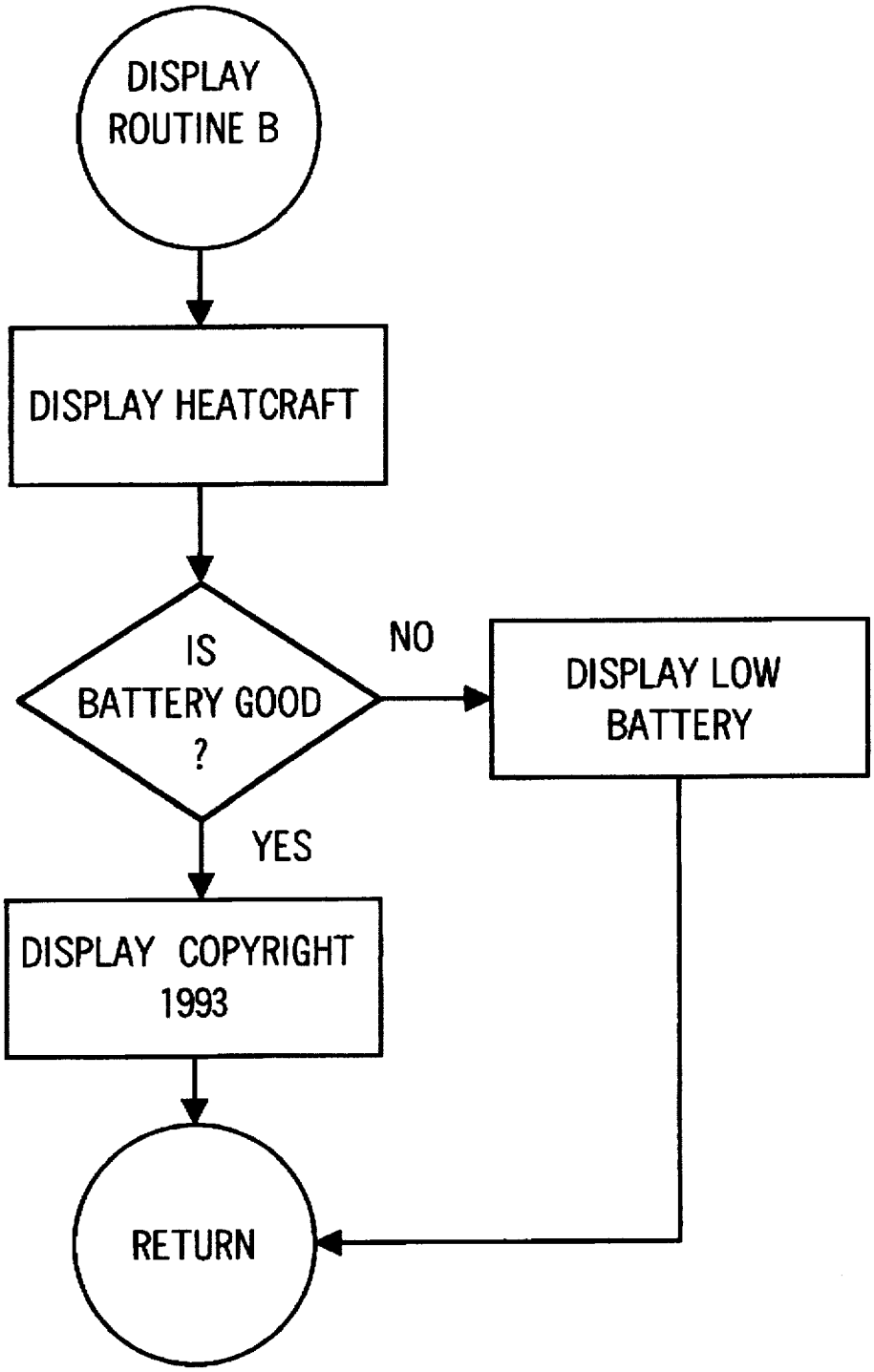

Display Routine B is depicted in FIG. 2F. Processor 16 controls display device 18 to display the word "HEATCRAFT" (Display HEATCRAFT) on the first line of display device 18 and the notice "Copyright 1993" (Display Copyright 1993) on the second line of display device 18. Further, a low battery condition, if applicable, is also displayed.

Referring again to FIG. 2D, assuming valid data is received within thirty seconds, processor 16 determines whether the system being monitored is a combination water heating/space heating system. If the Tank Temperature data indicates that the tank temperature equals 255° F. (OFF in hexadecimal code), then the system being monitored is not a combination water heating/space heating system. Further, if the Tank Temperature data indicates that the tank temperature is less than 16° F. (less than 10 in hexadecimal code), then the system being monitored is not a combination water heating/space heating system and the first line of display device 18 is not used. If, however, processor 16 determines that the tank temperature is between 16° F. and 254° F., then the system being monitored is assumed to be a combination water heating/space heating system and the Display First Line Routine (FIG. 2G) is executed.

Figure 2G:
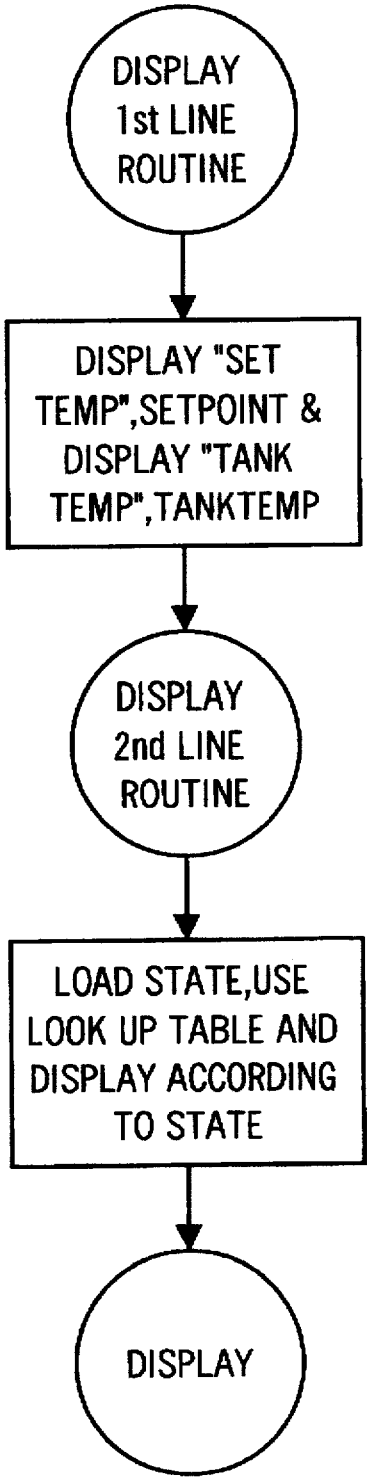

Referring to FIG. 2G, processor 16 controls display device 18 to indicate the tank temperature set point (Set Temp) and the actual water temperature flank Temp) on the first line of display device 18.

The Display Second Line Routine is also depicted in FIG. 2G. The second line of display device 18 is used to display the current state or operating mode of the system. The data indicative of the current state of the system is transmitted by processor 14 in hexadecimal code. Processor 16 uses a Look Up Table to decode the hexadecimal code transmitted by processor 14 and determine the actual operating state. The Look Up Table is indicated in the following Table I.

TABLE I

| STATE NAME | HEX VALUE | FAILFLG (BINARY) | DISPLAY |
|---|---|---|---|
| ST_WT | 01 | | WAIT |
| ST_PRG | 02 | | PURGE |
| ST_Y | 03 | | COOLING |
| ST_IGN | 04 | | IGN TRIAL#_(TRYCTR) |
| ST_G | 05 | | MANUAL |
| ST_RL | 06 | | ROLLOUT OPEN |
| ST_PPR | 07 | | PRESS SWITCH OPEN |
| | 08 | | IGN TRIAL#_(TRYCTR) |
| ST_FLEST | 09 | | SUCCESSFUL IGNITION |
| ST_FS | 0A | | FLAME |
| ST_LM | 0B | | LIMIT OPEN |
| ST_FF | 0C | | IGNITION FAILURE |
| ST_WG | 0E | XXXX XXX1 | W'GUARD LIMIT |
| | 0E | XXXX 1XX0 | BAD THERMISTOR |
| | 0E | XXXX 0X10 | W'GUARD PRESSURE |
| | 0E | XXXX 0100 | W'GUARD IGNITION |
| ST_DD | 0F | | CHANGE CONTROL |
| ST_DO | 11 | | DELAY OFF |
| ST_PF | 12 | | PRESS SW CLOSE |
| ST_FLSTB | 13 | | FLAME STABILIZATION |
| ST_PP | 14 | | POST PURGE |
| ST_BF | 15 | | BOARD FAILURE |
| ST_CB | 16 | | CONDENSATE BLOCK |
| ST_MIGN | 55 | | IGN TRIAL #_(TRYCTR) |
| LFS_WLM | 70 | | W'GUARD LIMIT |
| LFS_WPS | 71 | | W'GUARD PSW |
| LFS_WFF | 72 | | W'GUARD IGNITION |
| LFS_PF | 73 | | PSW CLOSE |
| FLS_RL | 74 | | FLAME ROLLOUT |
| LFS_LM | 75 | | LIMIT OPEN |
| LFS_CC | 76 | | CHANGE CONTROL |
| LFS_BF | 77 | | BOARD FAILURE |
| LFS_PPR | 78 | | PRESS SW OPEN |
| LFS_NN | 80 | | NONE |

When processor 16 determines the operating state, it controls display device 18 to display the operating state in human-understandable form. For example, if processor 16 determines that the state is ST_PPR, it will display "PRESS SWITCH OPEN" on display device 18, which indicates that a pressure switch for measuring the system's combustion air blower (not shown) discharge pressure is in an open position.

Referring again to FIGS. 2A and 2D, activation of input switch 22 (FIG. 1) results in processor 14 transmitting a signal indicative of the last known failure condition ("Last Fail State") of the system, instead of the current operating state of the system. If processor 16 determines that the state is greater than a predetermined value (6F in hexadecimal code), it will display the last known failure condition on the first line of display device 18. As indicated in Table I, the hexadecimal code assigned to each of the Last Fail States (LFS) is greater than state 111 (6F in hexadecimal code).

If the current state of the system indicates a failure condition or other malfunction, a Watchguard state (ST_WG) is indicated. As shown in Table I, there are four possible failure conditions indicated by the Watchguard state. Typically, a combination water heating/space heating system will include a temperature limit switch, a thermistor for sensing water temperature and a pressure switch. In the event of failure of any of these three sensors, a Watchguard state is indicated. The particular failure condition is indicated by an eight-bit binary code stored in the Failure Flag (Failflg) location in memory. A fourth Watchguard condition is indicated by an ignition failure, which results when ignition fails to occur after a predetermined number of tries (e.g., 6 tries). The control of a combination water heating/space heating system, including the Watchguard Routine, is described in greater detail in co-pending U.S. Pat. application Ser. No. 08/296,112, entitled "Combination Water Heating And Space Heating Apparatus", filed Aug. 25, 1994, now U.S. Pat. No. 5,544,645, the specification of which is incorporated by reference herein.

In accordance with the present invention, apparatus is provided for monitoring operation of a heating and/or cooling system. The monitoring apparatus is programmed to display the current operating mode of the system, including any failure condition or other malfunction. The apparatus provides passive monitoring and does not interrupt the main system control function, but rather waits for the system control to transmit data indicative of system operating modes. The apparatus is programmable for monitoring various types of heating and/or cooling systems and is particularly well-suited for use by a service technician to detect and diagnose system malfunctions and potential malfunctions.

Various embodiments of the invention have now been described in detail, including the best mode for carrying out the invention. Since changes in and modifications to the above-described embodiments may be made without departing from the nature, spirit and scope of the invention, the invention is not to be limited to said details, but only by the appended claims and their equivalents.

We claim:

1. Apparatus for on-site monitoring of a heating and/or cooling system, said apparatus comprising:

first processing means for processing data relating to operation of the system in accordance with a first set of program instructions and for transmitting coded data signals indicative of selected system operating conditions; and a portable display module having:

second processing means for receiving and processing said coded data signals in accordance with a second set of program instructions and for providing a human detectable output indicating said selected system operating conditions, said second processing means being operable to not transmit any signals to said first processing means so that there is only one-way communication between said first processing means and said second processing means; and connecting means for electrically connecting said module to said first processing means.

2. Apparatus of claim 1 further including user controllable input means for inputting a control signal to said first processing means, said first processing means being operative to transmit a coded signal indicative of a last known failure condition of the system in response to said control signal, even if said last known failure condition is not a current condition, said second processing means being operative to provide a human detectable output indicating said last known failure condition in response to said coded signal.

3. Apparatus of claim 1 wherein each coded data signal consists of a predetermined number of bits of binary code transmitted serially, all of said coded data signals having the same number of bits, said second processing means including means for discarding as invalid any coded data signal not having said predetermined number of bits, said first processing means being adapted to transmit another coded signal simultaneously with the transmission of each bit of binary code, said another coded signal indicating that said each bit of binary code being transmitted is part of the coded data signal.

4. Apparatus of claim 1 wherein said operating conditions include selected system failure conditions.

5. Apparatus of claim 1 wherein said module includes display means for displaying information in human readable form, said second processing means being operative to control said display means to display selected system operating conditions.

6. Apparatus of claim 5 wherein said second processing means is operative to control said display means to display an indication of the system's current operating mode.

7. Apparatus of claim 1 wherein said connecting means is an electrical conduit which is connectible to and disconnectible from a heating and/or cooling system to be monitored.

8. Apparatus for on-site monitoring of a gas heating system having automatic ignition control, said apparatus comprising:

first processing means electrically coupled to the system ignition control for processing information relating to selected ignition control conditions in accordance with a first set of program instructions and for transmitting coded data signals indicative thereof; and a portable display module having:

second processing means for processing said coded data signals in accordance with a second set of program instructions and for providing a human detectable output indicating selected ignition control conditions, said second processing means being operable to not transmit any signals to said first processing means so that there is only one-way communication between said first processing means and said second processing means.

9. Apparatus of claim 8 further including user controllable input means for inputting a control signal to said first processing means, said first processing means being operative to transmit a coded signal indicative of a last known failure condition of the system in response to said control signal, even if said last known failure condition is not a current condition, said second processing means being operative to provide a human detectable output indicating said last known failure condition in response to said coded signal.

10. Apparatus of claim 8 wherein each coded data signal consists of a predetermined number of bits of binary code transmitted serially, all of said coded data signals having the same number of bits, said second processing means including means for discarding as invalid any coded data signal not having said predetermined number of bits, said first processing means being adapted to transmit another coded signal simultaneously with transmission of each bit of binary code, said another coded signal indicating that said bit of binary code being transmitted is part of the coded data signal.

11. Apparatus of claim 8 wherein said ignition control conditions include selected ignition failure conditions.

12. Apparatus of claim 8 wherein said module includes display means for displaying information in human readable form, said second processing means being operative to control said display means to display selected ignition control conditions.

13. Apparatus of claim 12 wherein said second processing means is operative to control said display means to display an indication of a current ignition control condition.

14. Apparatus of claim 8 wherein said connecting means is an electrical conduit which is connectible to and disconnectible from the ignition control of the system.

15. Portable apparatus for on-site monitoring of a heating and/or cooling system of the type which is programmed to transmit coded data signals indicative of selected system operating conditions, said apparatus comprising:

processing means for processing said coded data signals transmitted hy the system in accordance with a predetermined set of program instructions and for providing a human detectable output indicating selected system operating conditions, said processing means being operable to not transmit any signals to the system so that there is only one-way communication between said processing means and the system; and connecting means for electrically connecting said processing means to the system.

16. Apparatus of claim 15 wherein each coded data signal consists of a predetermined number of bits of binary code transmitted serially, all of the coded data signals having the same number of bits, said processing means including means for discarding as invalid any coded data signal not having said predetermined number of bits.

17. Apparatus of claim 15 wherein said operating conditions include selected system failure conditions.

18. Apparatus of claim 15 further including display means for displaying information in human readable form, said processing means being operative to control said display means to display selected system operating conditions.

19. Apparatus of claim 18 wherein said processing means is operative to control said display means to display an indication of current system operating mode.

20. Apparatus of claim 15 wherein said connecting means is an electrical conduit which is connectible to and disconnectible from a heating and/or cooling system to be monitored.

* * * * *